US005815897A

United States Patent [19]

Longstreth

[11] Patent Number: 5,815,897

[45] Date of Patent: Oct. 6, 1998

[54] PLANTER CREMATION VAULT

[76] Inventor: C. Philip Longstreth, 134 Harding Way West, Galion, Ohio 44833

[21] Appl. No.: 662,361

[22] Filed: Jun. 12, 1996

[51] Int. Cl.[6] ..... A61G 17/00

[52] U.S. Cl. ..... 27/1; 47/79

[58] Field of Search ..... 27/1, 35; 47/79, 47/1.01, 81; 220/4.03, 23.6; 206/821

[56] References Cited

U.S. PATENT DOCUMENTS

| | | | |
|---|---|---|---|
| 2,326,414 | 8/1943 | Thompson | 206/821 X |
| 5,379,499 | 1/1995 | Jackson | 27/1 |

FOREIGN PATENT DOCUMENTS

| | | | |
|---|---|---|---|
| 9305747 | 4/1993 | WIPO | 27/1 |

*Primary Examiner*—Kien T. Nguyen

*Attorney, Agent, or Firm*—Jerry Semer

[57] ABSTRACT

This invention is basically a planter combined with a cremation vault. The planter portion of the planter cremation vault is a cylindrical tube with a closed bottom. Within that tube is fitted a liner which is also a cylindrical tube with a closed bottom. Within the liner the dirt and the plants are placed. The cremation chamber is a tube adapted to attach to the planter. The cremated remains are placed within the cremation chamber. On top of the cremated remains a Styrofoam spacer is placed. On top the Styrofoam disk is placed a memorabilia container. The cremation chamber is sealed by attaching it to the planter. An extension cremation chamber may be added to place a second individuals remains. This extension cremation chamber would be adapted to thread within the cremation chamber and to allow the planter to thread within its top. The extension cremation chamber is a cylindrical container with a closed bottom. The planter is than attach to seal the extention cremation chamber.

9 Claims, 9 Drawing Sheets

PLANTER CREMATION VAULT

FIELD OF THE INVENTION

This invention relates to a planter and more particularly to a planter which also is a cremation vault with memorabilia container.

BACKGROUND OF THE INVENTION

Cremation is becoming increasingly acceptable as an alternative to burial. In most cases the cremated remains are stored in a memorial urn. One on the objectives of this invention is to create a memorial urn that is decorative enough that it can be placed in any room of the home. A second objective of the this invention is to created a memorial urn that is also a planter for plants. Thus, applicant wishes to create a memorial urn that will fit right into the home with plants growing from it.

Another objective for the memorial urn is also to have a small container that is of sufficient size to contain objects of memorabilia from the deceased. Thus one of the objectives of applicant's invention is to create a cremation urn planter that also has a compartment for memorabilia for the deceased. As I pointed out some individuals wish to have the memorial urn within their home while others wish to have it outside in an area such as their garden. Thus, one of the objectives of this invention is to create a memorial urn that can be used both in the home and in the outdoors. The memorial urn has been designed to be able to withstand the weather and would fit perfectly in a garden setting.

Sometime individuals such as husband and wife liked to be kept together even in death. Thus, one of the objectives of this invention is to create a cremation urn planter in which two or more individuals remains can be kept.

Also after the remains have been kept in a planter for awhile the individual who has kept the planter cremation urn may wish to bury. Thus, one of the objectives of this invention is to create a planter cremation vault that can be easily adapted to be buried.

One of the objectives of the inventor was to produce a place for cremated remains that is similar to in ground burial. The planter cremation chamber has earth and plants placed in the planter on top of the cremation chamber or the remains just like burying an individual in the ground. The cremation chamber can be engraved and made very similar to a grave marker. The planter cremation chamber can be placed within the home or in the outdoors. The planter cremation chamber can also be buried.

SUMMARY OF INVENTION

This invention is basically a planter combined with a cremation vault. The planter portion of the planter cremation vault is a cylindrical tube with a closed bottom. Within that tube is fitted a liner which is also a cylindrical tube with a closed bottom. Within the liner the dirt and the plant is placed. The cylindrical tube planter at it's bottom has threads on its outsides. These threads are adapted to fit in the threads in of the cremation chamber. The cremation chamber is a tube and its top is threaded on the inside. These threads are adapted to fit the threads of the planter. The bottom the cremation tube is threaded on the outside. The threads at the bottom are adapted to fit within a base. To make the planter a cremation vault one places an o-ring is place over the threaded bottom. Then the cremation chamber is threaded into the base with the o-ring providing sealing between the base and the cremation chamber. Next the cremated remains are placed within the cremation chamber. On top of the cremated remains a Styrofoam spacer is placed. This Styrofoam spacer is a small disk of approximately the same dimensions as the inner dimensions of the cremation chamber. On top the Styrofoam disk is placed a memorabilia container. This container is a cylindrical container with a closed bottom and its top is threaded on the inside. The lid for the container is cylindrical in shape and has threads on its outside that are adapted to fit within the threads of the container. The lid has a small knob on top for grasping. Next the planter is placed on the cremation chamber. First an o-ring is placed around the planter then the threads at the bottom of the planter are threaded into the top of the cremation chamber. The planter has a closed bottom and thus the cremation chamber is fully closed and secured by the o-rings in the base and the planter. The planter can be farther sealed by a commercial thread sealer. Finally an insert is placed in the top where dirt and a plant may be placed. An extension cremation chamber may be added to place a second individuals remains. This extension cremation chamber would be adapted to thread within the cremation chamber and to allow the planter to thread within its top. The extension cremation chamber is a cylindrical container with a closed bottom. On the outside of the bottom of the extension cremation chamber are threads adapted to fit within the threads of the top of the cremation chamber. In placing the extension cremation chamber in the cremation chamber an o-ring is placed first around the bottom of the insert and then the extension cremation chamber is threaded into the cremation chamber to create a tight moisture proof seal. Then the remains of the second person are placed within the extension cremation chamber. After that the planter with an o-ring is threaded into the top the same as was done with the cremation chamber.

DETAILED DESCRIPTION OF THE PREFERRED EMBODIMENT

Figure 1:
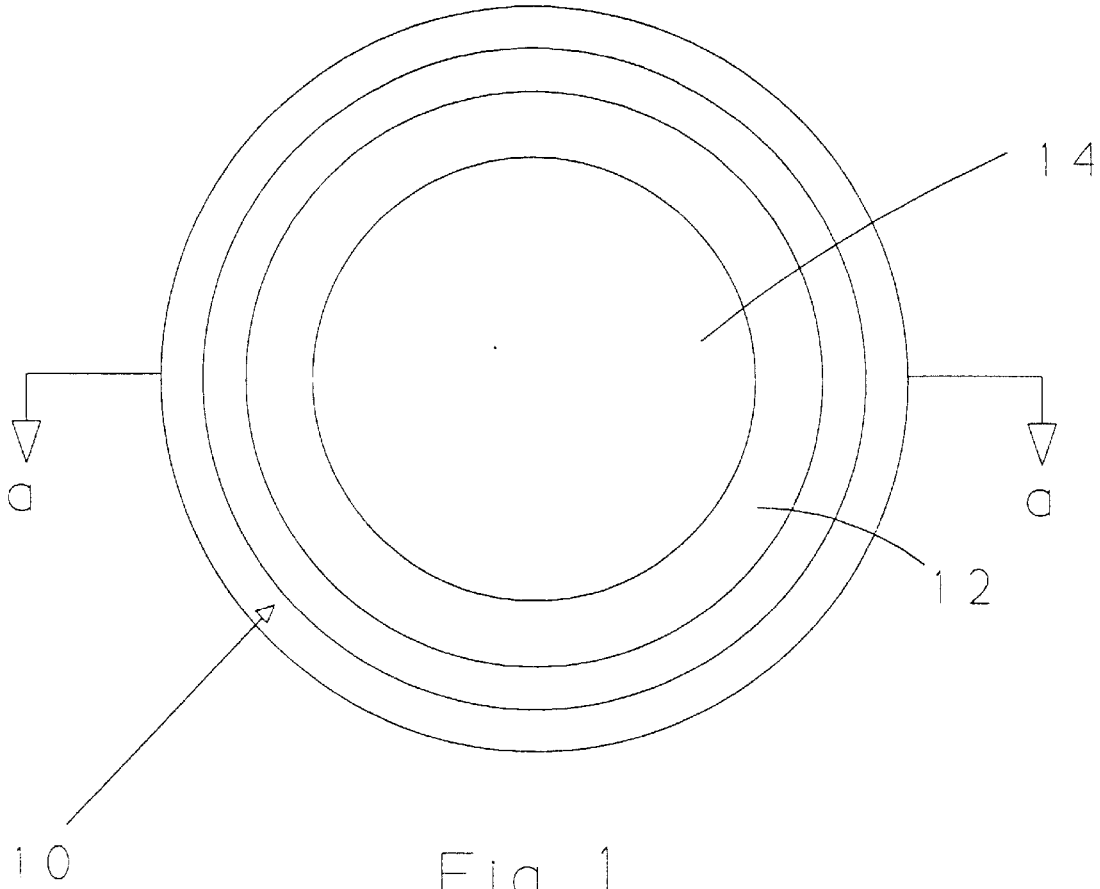
FIG. 1 is a top view of the base.
Figure 1A:
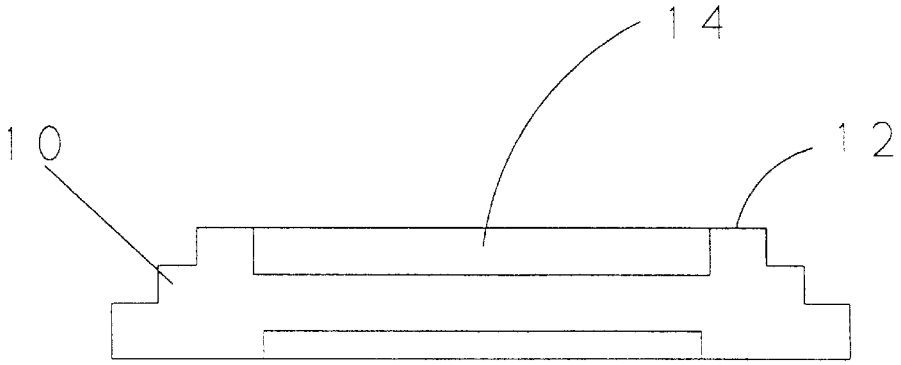
FIG. 1*a* is a sectional view of the base along line a—a of FIG. 1.

FIG. 1 shows a base 10 of the invention. The base 10 of the invention could be a cylindrical disk or it could be decorative. In the top 12 of the base 10 is a female opening 14 that is threaded.

Figure 2:
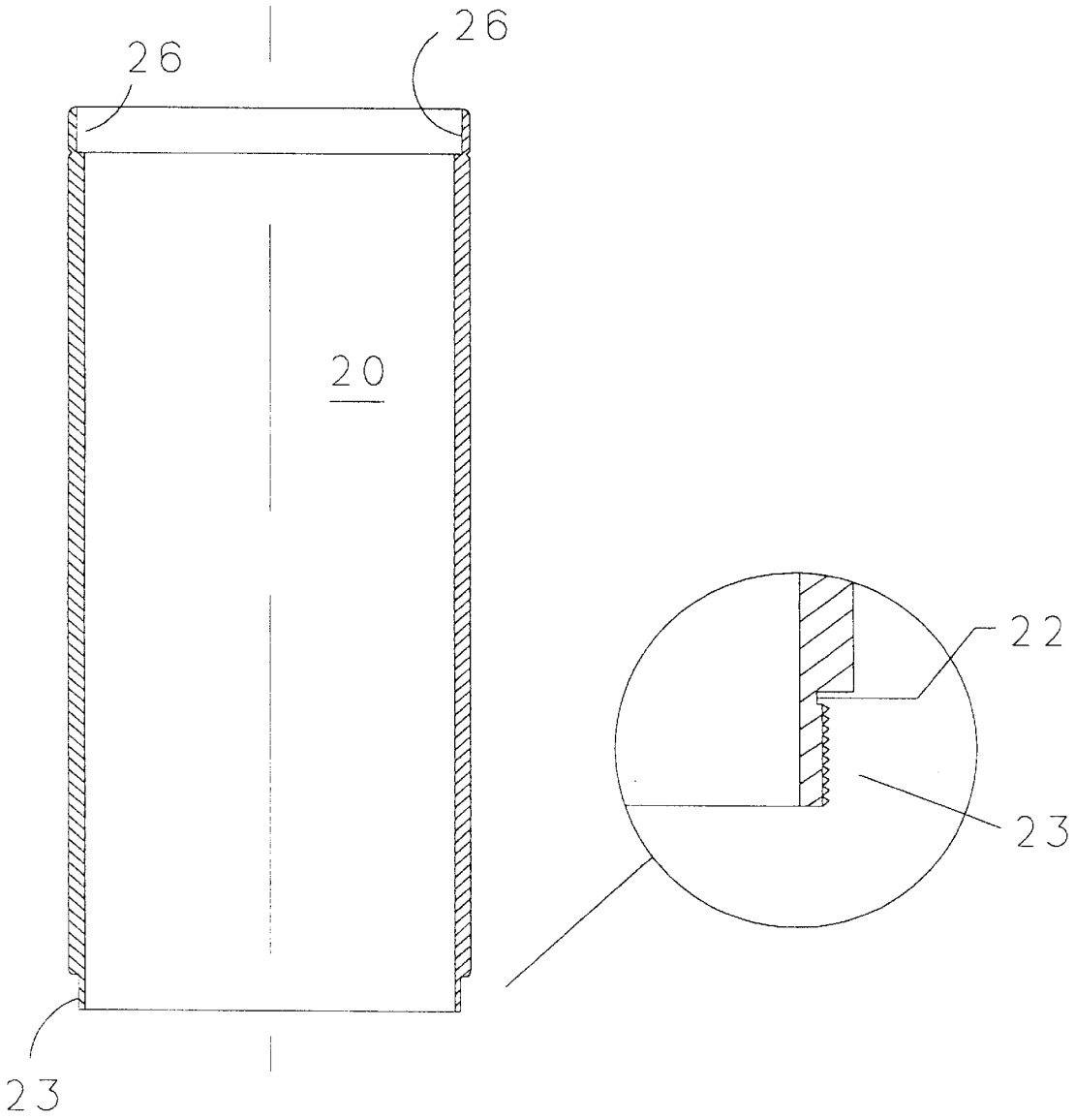
FIG. 2 is a side cutaway view of the cremation chamber.

FIG. 2 shows the cremation chamber 20 of the invention. The cremation chamber 20 of the invention is a cylindrical container that is open at both the top and bottom. In the preferred embodiment the cremation chamber 20 has an open bottom; however the cremation chamber could have a closed bottom. The bottom of the cremation chamber 20 is threaded on the outside and these threads 23 are adapted to fit within the opening 14 of the base 10. Just above the threads 23 at the bottoms of the cremation chamber 20 is a notch 22 adapted for an o-ring. The cremation chamber 20 is also threaded on the inside at its top 26.

Figure 3:
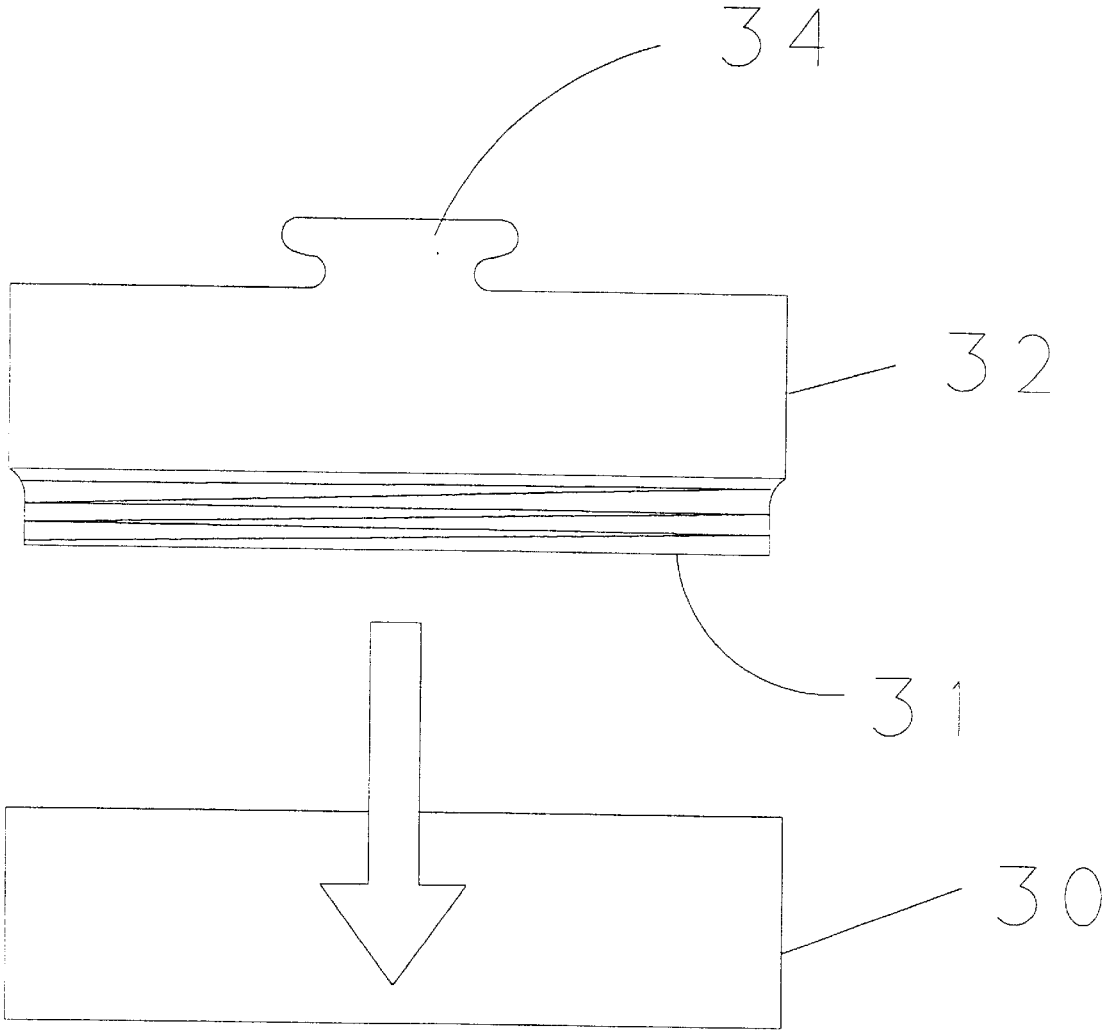
FIG. 3 is an exploded side view of the memorabilia container.

FIG. 3 shows the memorabilia container 30 and its lid 32. The memorabilia container is a cylindrical container with a closed bottom. The memorabilia container's 30 diameter is slightly less than the inner diameter of the cremation chamber 20. At the top of the memorabilia container 30 on it's inner diameter are threads. These threads are adapted to fit within the threads around the outside of the lid 32. The lid 32 is circular in shape with threads 31 around its outside adapted to fit within the threads at the top of the memorabilia container 30. On the top of the lid 32 is a knob 34 to allow easy opening of the container and the picking up and placing of the memorabilia container 30 within the cremation chamber 20.

Figure 4:
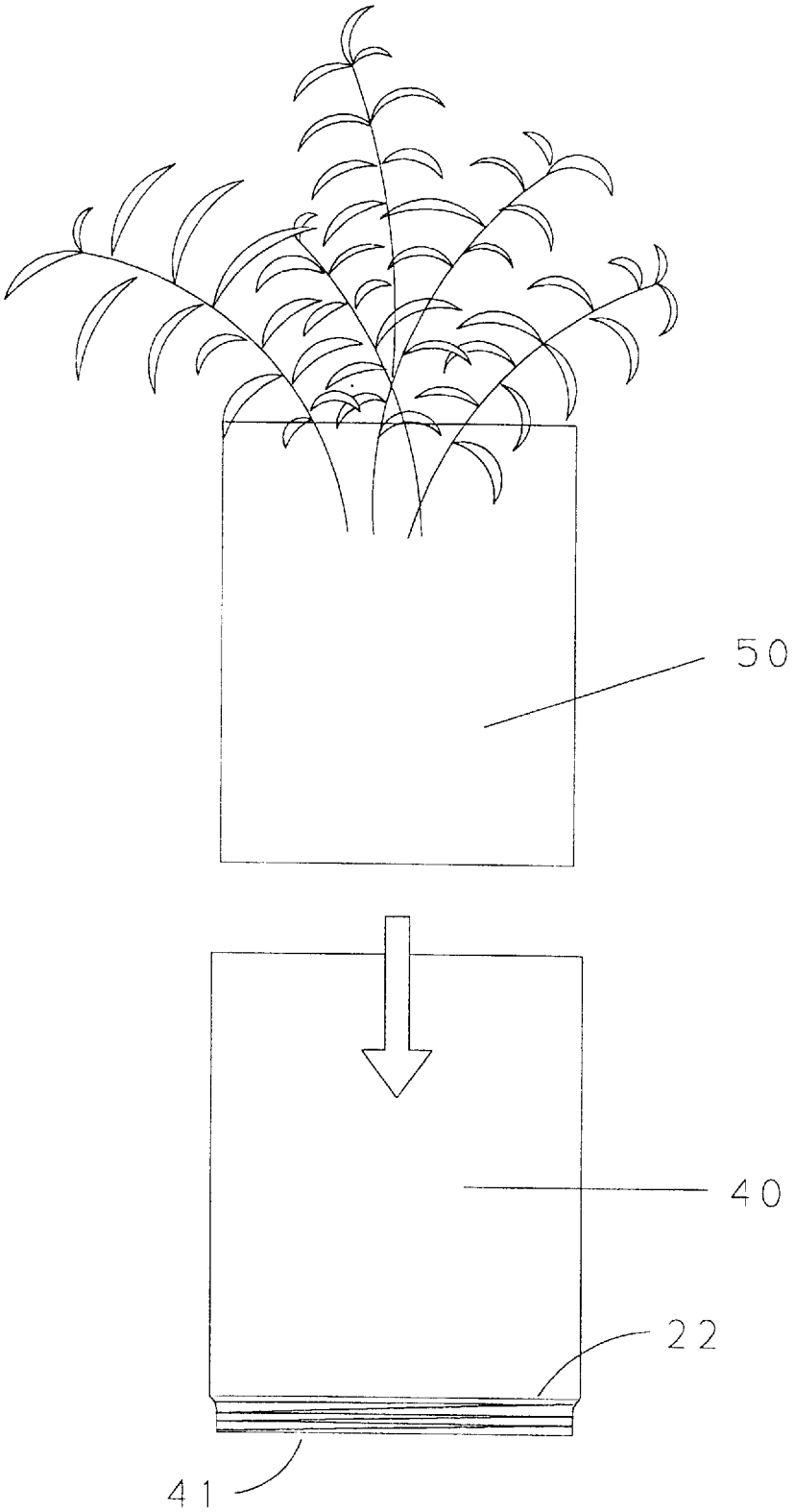
FIG. 4 is a side view of the planter and liner.
Figure 5:
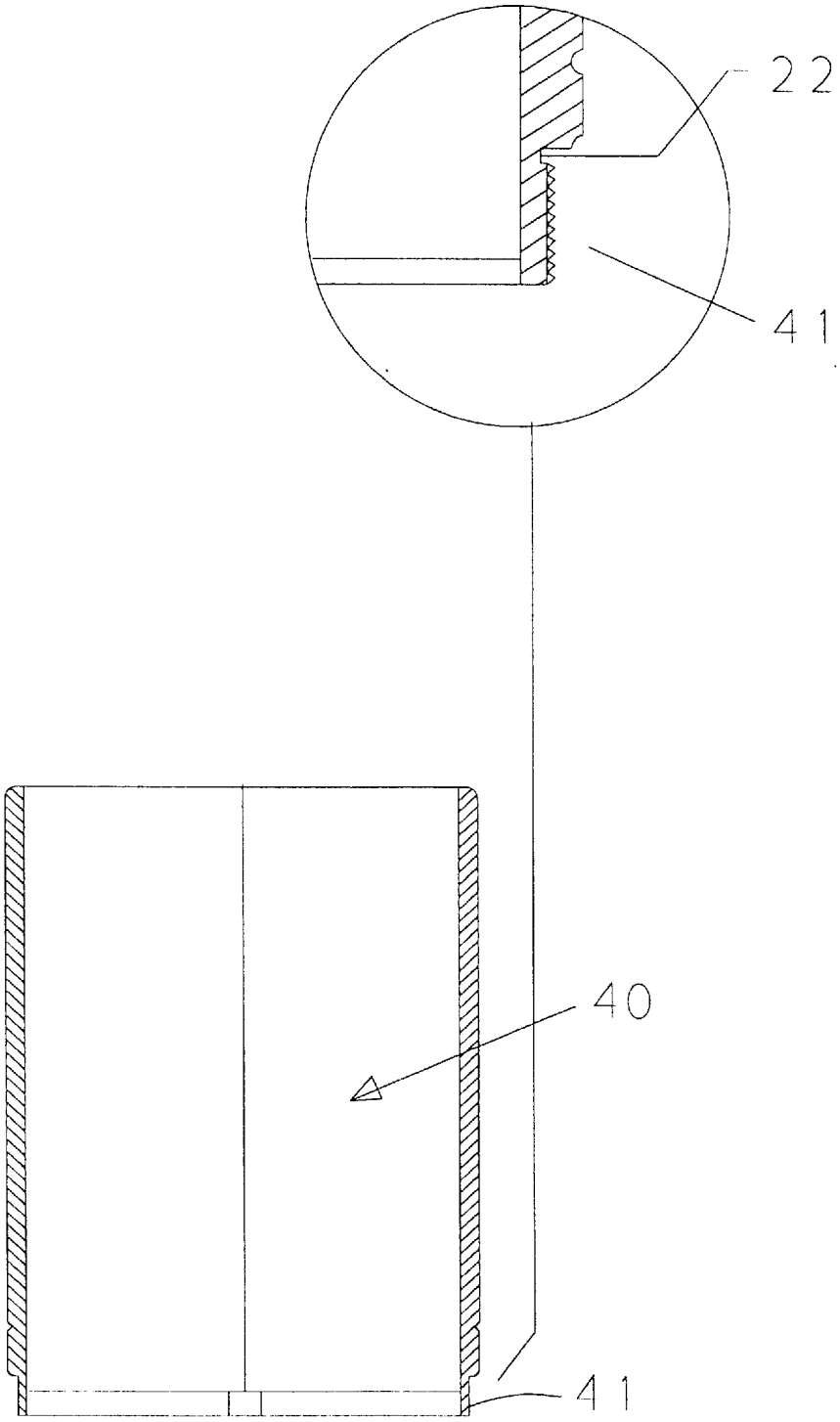
FIG. 5 is a side cutaway view of the planter.

FIGS. 4 and 5 shows the planter 40. The planter 40 is cylindrical in shape and has the same outer diameter as the cremation chamber 20. The planter 40 has a closed bottom and around the bottom on the outside are a set of threads 41 adapted to fit within the threads at the top of the cremation chamber 20. Also around the bottom on the outside just above the threads is a small notch 22 adapted for an o-ring.

FIG. 4 also shows a liner 50 which is cylindrical in dimensions and has a closed bottom. The liner 50 is adapted to fit within the planter and within the liner 50 dirt is placed and a plant can be planted.

Figure 6:
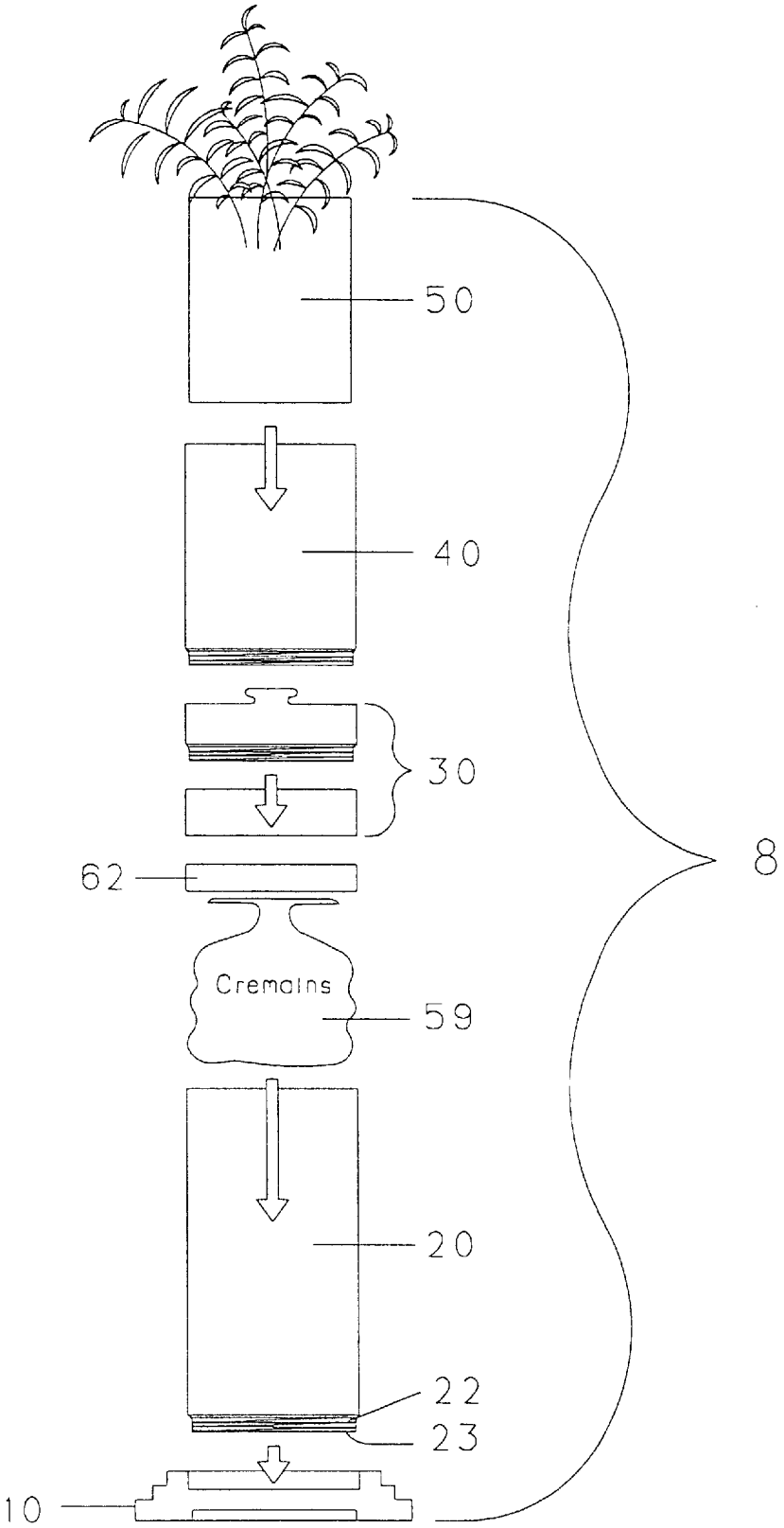
FIG. 6 is an exploded view of the planter cremation vault.

FIG. 6 shows how the planter cremation vault 8 fits together. First an o-ring is placed around the bottom of the cremation chamber 20 in the notch 22 slightly above the threads at the bottom of the cremation chamber 20. Then the cremation chamber 20 is threaded into the base 10. The o-ring provides a tight waterproof seal. A thread sealer can also be added to make the seal water and air tight. Next the cremated remains 59 are placed within the cremation chamber 20. On top of the cremated remains 59 a Styrofoam 62 disk whose outer diameter is slightly less than the inner diameter of the cremation chamber 20 is placed. On top of the Styrofoam disks 62 is placed the memorabilia container 30 as shown in FIG. 3. Then the o-ring is placed around the planter 40 in the notch 22 slightly above the thread 41 at the bottom of the planter 40. The planter 40 is then threaded into the cremation chamber 20. A thread sealer can also be added to ensure that the cremation chamber 20 is fully sealed and is air and water tight. Into the planter 40 is placed a liner 50 for the dirt and the plant.

Figure 9:
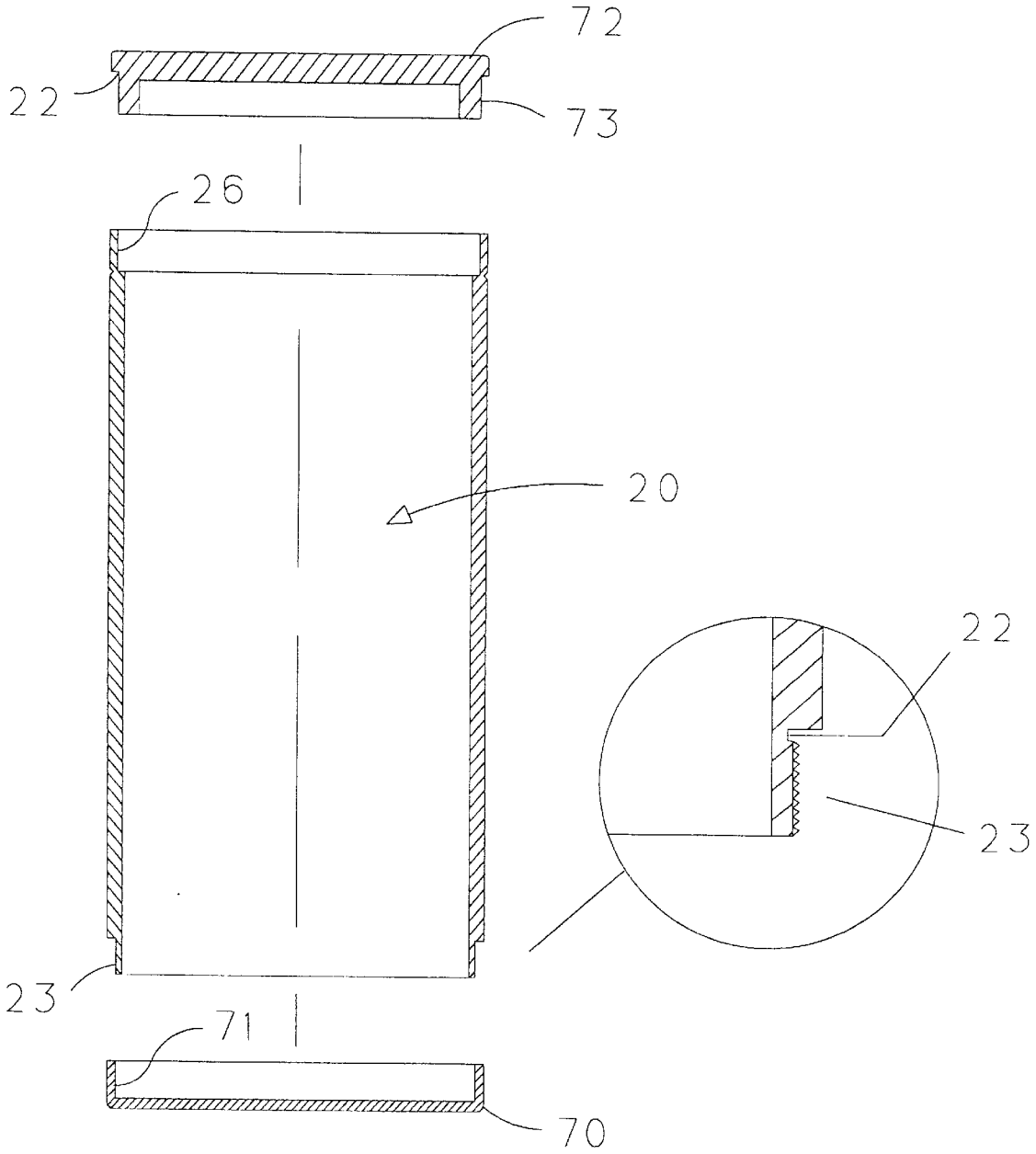
FIG. 9 is an exploded view of the burial portion of the planter cremation vault.

FIG. 9 shows how the cremation vault can be changed from a planter into a cremation vault that can be buried. To accomplish this the planter 40 and the base 10 are removed from the cremation chamber 20. To the bottom of the cremation chamber is attached a cap 70. Cap 70 is a cylindrical cap of the same diameter as the cremation chamber 20. The cylindrical cap 70 is threaded on the inside and these threads 71 are adapted to fit the threads 23 at the bottom of the cremation chamber 20. The top of the cremation chamber 20 is sealed by end cap 72. End cap 72 is cylindrical in shape with its diameter slightly less than the diameter of the cremation chamber 20. Around the outside of cap 72 are threads 73 adapted to fit in the threads 26 at the top of the cremation chamber 20. To prepare the planter cremation vault for burial as I stated above the base 10 and the planter 40 are removed from the cremation chamber 20. Then an o-ring is placed in the notch 22 above the threads at the bottom of the cremation chamber 20. Then the cap 70 is threaded on the cremation chamber 20. The remains 61 are then placed inside the cremation chamber. A Styrofoam disk 62 whose outer diameter is slightly less than the inner diameter of the cremation chamber 20 is placed on top of the cremated remains 61. Then the memorabilia chamber 30 can be placed within the cremation chamber 20. Then another o-ring is placed in the notch 22 at the top of the threads 73 on the end cap 72. Then the end cap 72 is threaded into the cremation chamber 20. Commercial thread sealers can be used to make both end caps sealed water and air tight. The cremation chamber 20 is now ready for burial into the ground.

Figure 7:
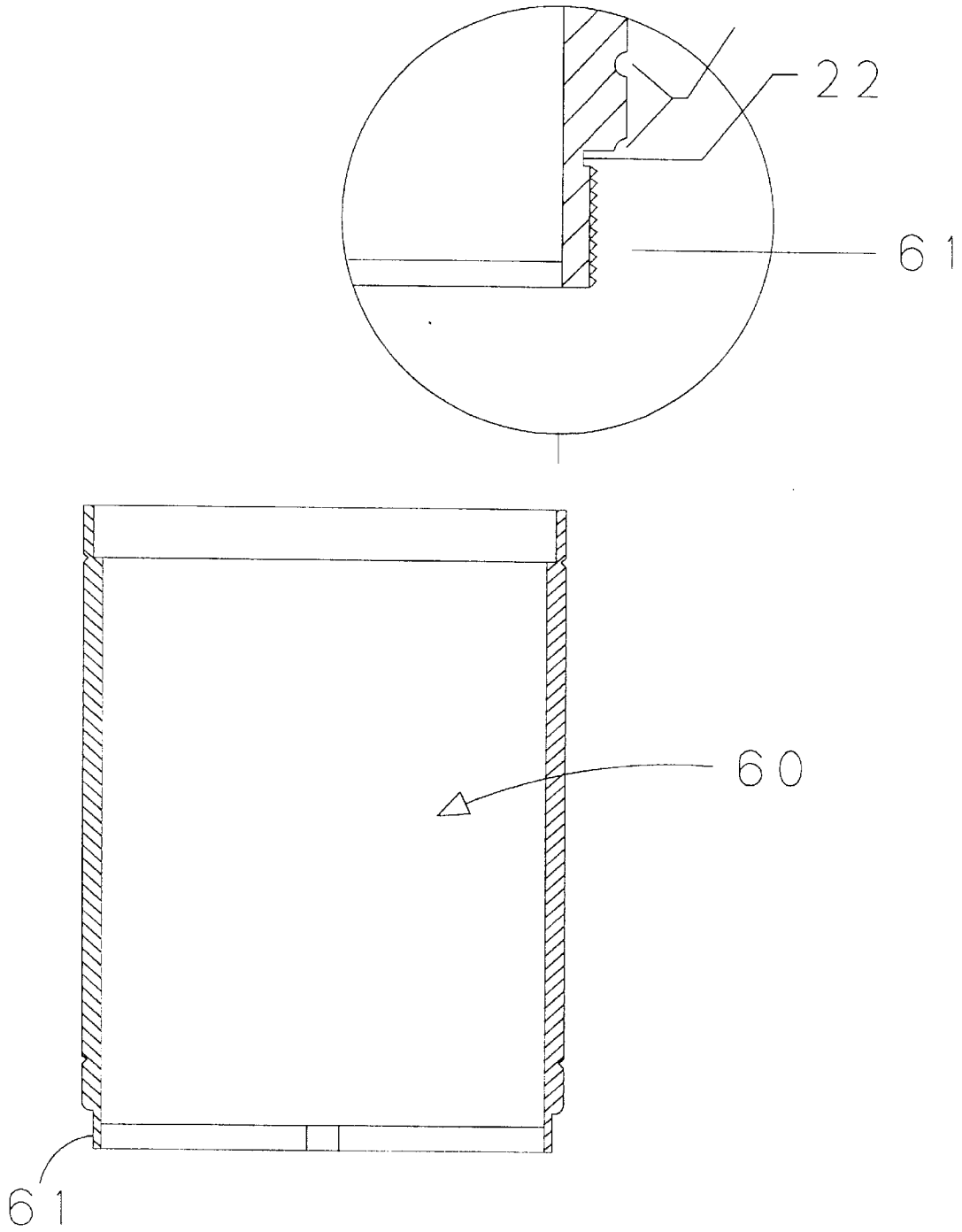
FIG. 7 is a side cutaway view of the extension cremation chamber.
Figure 8:
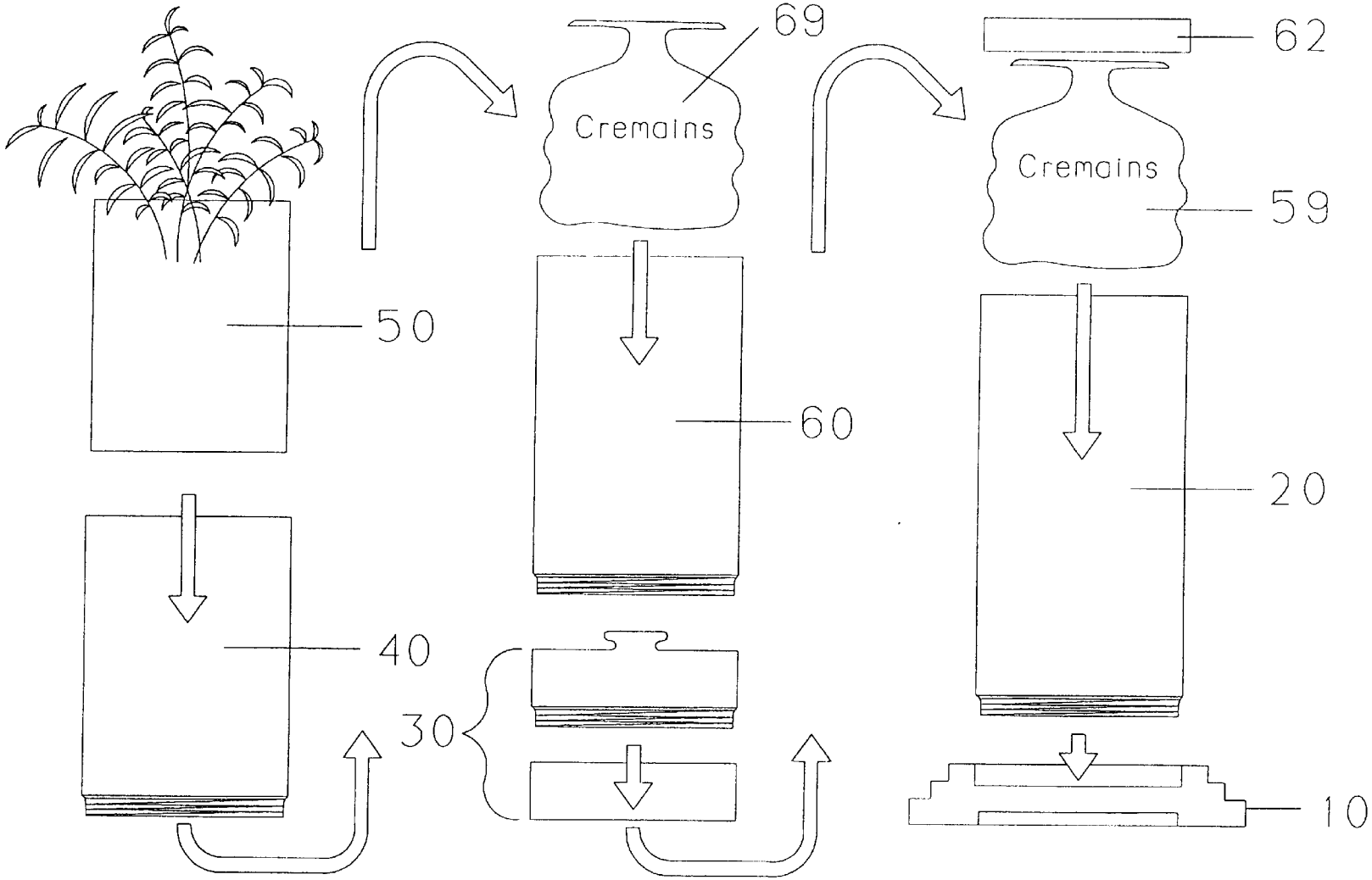
FIG. 8 is an exploded view of the planter cremation with the extension cremation chamber.

FIG. 7 shows an extension cremation chamber 60 that is used in another embodiment of the invention shown in FIG. 8. The extension cremation chamber 60 is a cylindrical container with a closed bottom. The extension cremation chamber 60 is of the same dimensions in outer diameter as the original cremation chamber.

FIG. 8 shows how the extension cremation chamber 60 fits with the other parts of the invention. In this embodiment the base 10, cremation chamber 20, the cremated remains 59, the Styrofoam spacer 62, and the memorabilia container 30 are constructed and put together the same as in the previous embodiment. Then the extension cremation chamber 60 is added to the top of the cremation chamber 20. On the bottom of the extension cremation chamber 60 is a set of threads 61 that is adapted to fit within the threads 26 on the top of the cremation chamber 20. Also just above the threads is a notch 22 adapted for an o-ring. An o-ring is placed in the notch 22 and the extension cremation chamber 60 is threaded into the cremation chamber 20. A thread sealer can also be added to be sure that the seal of the cremation chamber 20 is both air and water proof. Then the second set of remains 69 are placed in the extension chamber 60. The extension cremation chamber 60 also has a set of threads 68 at its top on its inner surface. These threads 68 are adapted to fit the threads at the bottom of the planter 40. As in the previous embodiment an o-ring is placed in the o-ring notch 22 of the planter 40 and the planter 40 is threaded into the extension cremation chamber 60. A thread sealer can be used to make this seal air and water proof. Then of course a liner 50 is placed within the planter 40 and the soil and plant is added to the planter 40.

The extension cremation chamber 60 and the cremation chamber 20 can both be buried in the ground. End cap 72 will fit the threads of the top of the of extension cremation chamber 60. To bury both the extension cremation chamber 60 and the cremation chamber 20 one firsts removes base 10 from the bottom of cremation chamber 20 and planter 40 from the top of extension cremation chamber 60. Then an o-ring is placed in notch 22 above the threads at the bottom of the cremation chamber 20. Then end cap 70 is threaded in cremation chamber 20. The remains 61 are placed inside the cremation chamber 20. A Styrofoam disc 62 whose outer diameter is slightly less than the inner diameter of the cremation chamber 20 is placed on top of the cremated remains 61. Then the memorabilia chamber 30 can be placed within the cremation chamber 20. Then an o-ring is placed in notch 22 which is just above the threads 61 of the extension cremation chamber 60. Then the extension cremation chamber is threaded into the cremation chamber 20. A thread sealer can also be added to insure that the seal of the cremation chamber 20 and the extension cremation chamber 60 is both air and water tight. Then the second set of remains 69 are placed within the cremation chamber 60. Then another o-ring is placed in notch 22 at the top of the threads 73 on the end cap 72. Then the end cap 72 is threaded into the extension cremation chamber 60. A commercial thread sealer can be used to make both end caps water and air tight. The cremation chamber 20 and the extension cremation chamber 60 are now ready for in ground burial. It should also be noted that extension chamber 60 could be buried alone. End caps 70 and 72 will fit the two ends of extension chamber 60 and it can be buried in the ground similar to cremation chamber 20.

All the parts of the planter cremation vault in the preferred embodiment are made out of aluminum. Also the end caps for the burial of the cremation vault and the extension cremation chamber are made out of aluminum in the preferred embodiment. However, all these parts could be made out of brass, cooper, stainless steel, plastic, ceramic or other materials known in the art that are decorative and durable and can be formed in the proper form for this invention. Also it would not be necessary for the entire planter cremation vault made out of the same substance. One of the important features of the planter cremation chamber is that the cremation chamber can be engraved. Thus, the cremation chamber can be made very similar and can have the same information placed on it as a grave monument.

Changes and modifications in the specificity described embodiments can be carried out without departing from the scope of the invention which is intended to be limited only by the scope of the appending claims.

I claim:

1. A planter cremation chamber comprising:

a. a first container with an open top; and, b. a second container adapted to be a planter for live plants; and, c. a means for attaching the second container such that it seals the first container's open top;

d. a memorabilia chamber adapted to fit within the first container.

2. A planter cremation chamber as in claim 1 further comprising:

a. a threaded base; and, b. the first container has an open threaded bottom: and, c. the first container threads into the base such that it seals the first container's open bottom and the base holds the first container off the surface on which the planter commission chamber sits.

3. A planter cremation chamber as in claim 1 wherein:

a. the first and second container are cylindrical.

4. A planter cremation chamber as in claim 1 further comprising:

a. a third container adapted to attach to the open top of the first container; and, b. a means for attaching the third container such that it seals the first container's open top.

5. A planter cremation chamber as in claim 4 further comprising:

a. the first container is releasable attached to the third container; and, b. a means for sealing the first and third container to make the first and third containers air and water tight so that they can be buried; and, b. whereby the second container is removed from the first and third container and sealed by the means for sealing such that the first and second containers can be buried.

6. A planter cremation chamber as in claim 5 wherein:

a. the means for sealing is an end cap that seals the first and third container.

7. A planter cremation chamber as in claim 1 further comprising:

a. the first container is releasably attached to the second container; and, b. a means for sealing the first container with and air and water tight seal so that the first container can be buried; and, c. whereby the second container is removed from the first container and the first container is sealed by the means for sealing sufficient for burial.

8. A planter cremation chamber as in claim 7 wherein:

a. the means for sealing is two end caps that seal both ends of the first container.

9. A planter cremation chamber as in claim 7 wherein:

a. the means for sealing is an end cap that seals the first container.

* * * * *